US007422551B2

(12) United States Patent
Monti

(10) Patent No.: US 7,422,551 B2
(45) Date of Patent: Sep. 9, 2008

(54) METHOD FOR ERECTING TUBULAR BLANKS AND A STATION, IN WHICH THIS METHOD IS CARRIED OUT

(75) Inventor: Giuseppe Monti, Pianoro (IT)

(73) Assignee: Marchesini Group S.p.A., Pianoro (Bologna) (IT)

( * ) Notice: Subject to any disclaimer, the term of this patent is extended or adjusted under 35 U.S.C. 154(b) by 0 days.

(21) Appl. No.: 11/536,071

(22) Filed: Sep. 28, 2006

(65) Prior Publication Data

US 2007/0072755 A1 Mar. 29, 2007

(30) Foreign Application Priority Data

Sep. 28, 2005 (IT) ..... BO2005A0583

(51) Int. Cl.
*B31B 1/78* (2006.01)
*B65B 43/26* (2006.01)
*B31B 1/80* (2006.01)

(52) U.S. Cl. ..... 493/309; 493/313; 53/381.1

(58) Field of Classification Search ..... 493/309, 493/313, 55, 310, 123, 314, 316; 53/381.1, 53/382.2, 382.3
See application file for complete search history.

(56) References Cited

U.S. PATENT DOCUMENTS 2,630,742 A * 3/1953 Hall ..... 493/309
2,887,021 A * 5/1959 Duffy et al. ..... 493/313
3,057,267 A * 10/1962 Johnson, Jr. ..... 493/309
3,397,624 A * 8/1968 Currier, Jr. et al. ..... 493/27
3,420,036 A * 1/1969 Hutchinson ..... 53/566
3,613,526 A * 10/1971 Jones ..... 493/313
4,006,670 A * 2/1977 Royal ..... 493/10
4,160,406 A * 7/1979 Nowacki ..... 493/125
4,170,929 A * 10/1979 McDowell ..... 493/313
4,232,591 A * 11/1980 Karpinsky ..... 493/314
4,331,435 A * 5/1982 Nowacki ..... 493/178
4,578,054 A * 3/1986 Herrin ..... 493/126
4,629,446 A * 12/1986 Focke ..... 493/317
6,070,396 A * 6/2000 Rinaldi et al. ..... 53/504
6,669,616 B1 * 12/2003 Bierenacki et al. ..... 493/316
6,872,176 B2 * 3/2005 Wyss et al. ..... 493/55
2004/0023768 A1 * 2/2004 Jaen ..... 493/55

FOREIGN PATENT DOCUMENTS

DE 198 08 791 A1 9/1999
EP 0 447 375 9/1991
EP 0 978 453 A1 2/2000
WO WO 98/57857 12/1998

* cited by examiner

*Primary Examiner*—Paul R Durand
(74) *Attorney, Agent, or Firm*—William J. Sapone; Coleman Sudol Sapone P.C.

(57) ABSTRACT

In a station for erecting tubular blanks in boxes, a gripping and raising unit engages a second lateral wall of the blank and subsequently raises the blank into a 90° rotation, so that the blank assumes, due to raising and rotating and because of the weight, a parallelepiped shape with a vertical axis. A first folder is operated by a first actuator in step relation with rotation of the blank and folds at least a first lateral wall of the blank adjacent to the second lateral wall, engaged by the gripping unit, to erect, the blank in a box with a vertical axis.

14 Claims, 7 Drawing Sheets

METHOD FOR ERECTING TUBULAR BLANKS AND A STATION, IN WHICH THIS METHOD IS CARRIED OUT

FIELD OF THE INVENTION

The present invention relates to boxing machines, with particular reference to a station for erecting tubular blanks in boxes.

BACKGROUND OF THE INVENTION

As it is known, the boxing machines are aimed at boxing articles or packages of articles of different kind; in general, the operations occurring in similar machines include the withdrawal of a tubular blank in flat folded configuration from a magazine, erecting the blank, so that it assumes a parallelepiped rectangular section, introduction, according to a lateral or vertical direction, of articles or packages of articles into the unfolded blank, folding the blank flaps and their mutual sealing, so as to define the bottom and the cover of a corresponding box containing the articles.

It is understood that some of these operations can be carried out in a different order with respect to the described one, or they can have more steps (for example, it can include a first folding of the flaps forming the box bottom, filling of the blank with articles and then, folding the flaps forming the box cover), in relation to the type of machine taken into consideration.

The way of filling of the box being formed remains the same, that is it includes the introduction of the articles, parallel to the axis of the erected tubular blank arranged to be squared.

A similar boxing machine, which is described in the European Patent EP 0 036 399, introduces the articles into the erected blank from one side.

The machine described in the above mentioned patent includes a vertical magazine, containing a plurality of tubular blanks piled up in a flat, horizontal configuration, and having an outlet section situated below in a position corresponding to the pile bottom.

Means for supporting the plurality of blanks are associated to the magazine, so as to allow the withdrawal of one blank at a time from the pile bottom.

A flat folded tubular blank is a blank formed by two superposed sheets set in touch with each other and connected along two opposite ends.

The blank has longitudinal and transversal pre-creasing lines, facilitating its folding, so as to define the lateral walls and edges of a corresponding box.

Each single blank is withdrawn from a pile by suction means, e.g. suction cups, carried by a carriage situated below the magazine and moving between a blank withdrawal station and a container forming and filling station.

The suction cups, defining first and second suction means, are aimed at gripping respectively the two lateral lower walls (first and second lateral wall) of the pile lowermost blank, making the blank disengage from the magazine supporting means, after the carriage movement from the withdrawal station toward the forming and filling station.

The first suction means are activated only for the time necessary for the disengagement of the pile lowermost blank, while the second suction means remain active during the carriage downward translation and during the subsequent forming and filling steps for obtaining the corresponding box.

One end of a first arm is hinged to the carriage, and its other end is articulated to a second arm, formed respectively by a first and second portion, at right angle to each other, and in turn hinged to the apparatus structure.

The arm length and position with respect to the carriage are such as to determine prefixed actions on the blank during the relative erecting operations: actually, the carriage downward translation corresponds to the first arm striking the blank first lateral wall and the gradual erecting of the blank, which reaches the open-squared position in the forming and filling station, with the first and second portions of the second arm parallel respectively to the first and second lateral wall.

Thus, the tubular blank assumes a parallelepiped form, with a rectangular cross-section, and maintains it due to the action of the second suction means and the action of the suction cups (third suction means), mounted on the first portion of the second arm and activated just a moment before the carriage reaches the forming and filling station.

The suction action continues for the time necessary to form the box bottom, to introduce thereinto an ordered pile of articles and to define the box cover.

First and second folding means, identical to each other and operated in different times, are aimed at folding the erected blank flaps, so as to define respectively the bottom and the cover of the corresponding box.

The operations carried out after the blank erecting are as follows: folding the flaps, which define the bottom of the box being formed, introduction of an ordered pile of articles into the blank, folding of the flaps, which define the box cover and pulling the so defined box toward the taping belt, for subsequent sealing operations to conclude the working cycle.

Therefore, the just described apparatus belongs to the type of boxing machine, which withdraws a tubular blank in flat horizontal configuration and erects the latter keeping with its axis oriented horizontal.

SUMMARY OF THE INVENTION

The object of the present invention is to propose a station for erecting tubular blanks in horizontal flat folded configuration, which allows introduction of the articles, in accordance to a vertical direction, into the box being formed, in other words, a station is proposed for erecting tubular blanks, so that they assume parallelepiped form with rectangular cross-section and vertical axis.

Therefore, the invention proposes a newly conceived station for erecting tubular blanks, which is designed to be a part of a boxing machine for in-vertical feeding of the blanks with articles.

Another object of the present invention is to propose a station, whose structure is essential, and which is reliable, highly productive and relatively cheap with respect to known solutions.

A further object of the invention is to propose a method, which allows to erect tubular blanks in horizontal flat configuration, making them assume a parallelepiped form with rectangular cross section and vertical axis.

The above object will be pursued by inventing also a simple method, by which a high production rate can be performed and relatively low costs are required with respect to known solutions.

A still further object of the invention is to propose a newly conceived method for erecting tubular blanks in horizontal flat configuration; in this sense, the blanks are erected along a vertical axis, simplifying the subsequent in-vertical filling steps of the corresponding boxes being formed.

The above object is obtained by conceiving a simple, essential method, by which a high production speed can be achieved.

The above mentioned objects are obtained, in accordance with the contents of the claims, by a station for erecting tubular blanks in boxes, with each blank including two superposed sheets connected along opposite ends of the sheets to define a flat folded configuration, with longitudinal pre-creasing lines made in said sheets for defining a first and a second lateral walls in each sheet and for facilitating folding of the blank, and with transversal pre-creasing lines made in the sheets for defining and facilitating folding of flaps of the blank, to which station said tubular blanks are conveyed one by one in a substantially horizontal position by driving means, with said erecting station including:

a gripping and raising unit for gripping said first lateral wall and for raising the blank in a way such that said blank rotates by a 90° angle;

first folding means acting on at least one second lateral wall, adjacent to said first lateral wall engaged by the gripping means of said unit, in step relation with the rotation of the blank, so that the blank assumes a parallelepiped shape with vertical axis.

The above mentioned station is conceived to carry out a method for erecting tubular blanks in boxes, with each blank including two superposed sheets connected along opposite ends of the sheets to define a flat folded configuration, with longitudinal pre-creasing lines made in said sheets for defining a first and a second lateral walls in each sheet and for facilitating folding of the blank, and with transversal pre-creasing lines made in the sheets for defining and facilitating folding of flaps of the blank, the method including:

conveying said tubular blanks one by one in horizontal arrangement, to a tubular blank erecting station;

gripping a first lateral wall of each tubular blank and raising said tubular blank by a 90° rotation;

striking at least one second lateral wall of the blank, adjacent to said first lateral wall engaged by the gripping action, so as to arrange the second lateral wall at right angle with respect to said first lateral wall, with consequent erecting of the blank taking a parallelepiped form with a vertical axis.

BRIEF DESCRIPTION OF THE DRAWINGS

The characteristic features of the invention, which are not evident from what has been just said, will be pointed out in the following description of some preferred but not exclusive embodiments, with reference to the enclosed figures, in which.

DISCLOSURE OF THE PREFERRED EMBODIMENTS

Having regards to the above Figures, the general reference S1 indicates a station, proposed by the invention, in which the tubular blanks 1 are erected.

Figure 1:
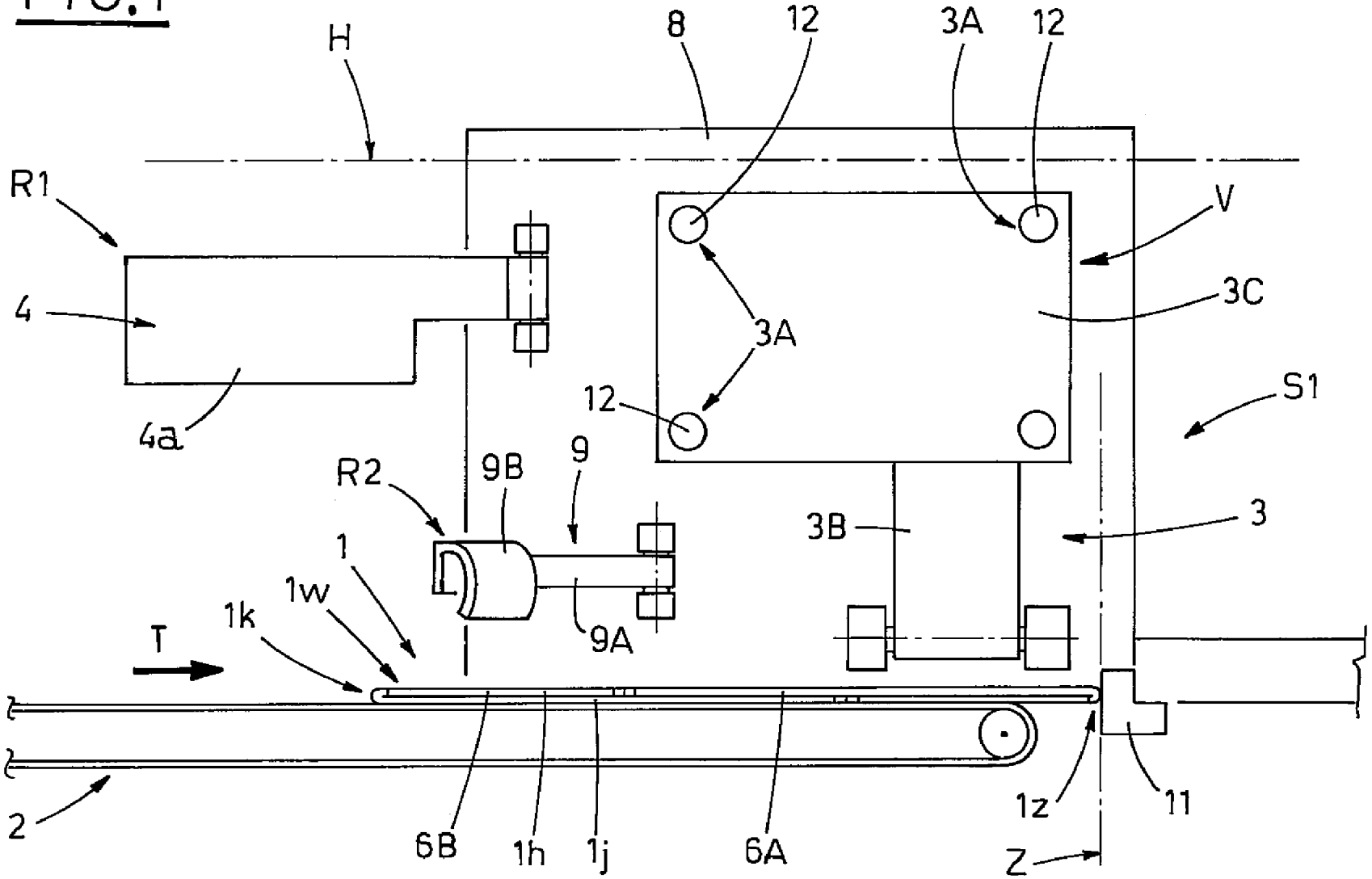
FIG. 1 is a schematic, front view of the station, proposed by the invention, in a first significant work configuration.

Means 2 convey the flat folded tubular blanks 1, kept in horizontal position, one by one, toward the station S1, up to a fixed abutment 11, see FIG. 1, which defines a first fixed vertical reference plane Z.

The means 2 include e.g. a conveying belt, which receives the tubular blanks 1 from a magazine (not shown) and conveys them in a driving direction T, to the erecting station S1.

Each tubular flat folded blank 1 conveyed to the station S1, as it has been said, lays in horizontal position and includes two sheets 1*h*, 1*j*, superposed to each other and connected along two opposite ends 1*k*, 1*z*.

The tubular blanks 1 have also longitudinal and transversal pre-creasing lines, which facilitate the blank erecting, defining lateral walls 6, the first lateral wall 6A, the second lateral wall 6B, the flaps 5, the first lower flap 5A and the second lower flap 5B of a corresponding box.

A carriage 8 is moved by relative actuator means, not shown, between the erecting station S1 and a work station, not shown as not relevant to the invention, in which the erected blanks are filled with articles or packages of articles moved in vertical direction.

The carriage 8 bears a unit 3, which grips and lifts the blank 1 so that it rotates, and first and second folding means 4, 9.

The gripping and raising unit 3 includes an arm 3B hinged to the carriage 8 according to a horizontal direction, perpendicular to the one defined by the longitudinal pre-creasing lines of the tubular blanks 1, reaching the erecting station S1.

The arm 3B supports a plate 3C, which carries gripping means 3A, e.g. a plurality of suction cups 12, connected to a vacuum source, not shown.

In the shown example, there are four suction cups 12, each of which situated near the vertices of the plate 3C.

Suitable actuator means, likewise not shown since known, move the arm 3B between a horizontal position O and a vertical position V (see for example FIG. 2), so as to carry out a 90° rotation between the two positions.

In particular, in the position V, the suction cups 12 lye in a second fixed vertical ideal plane K, perpendicular to the first plane Z.

Figure 5A:
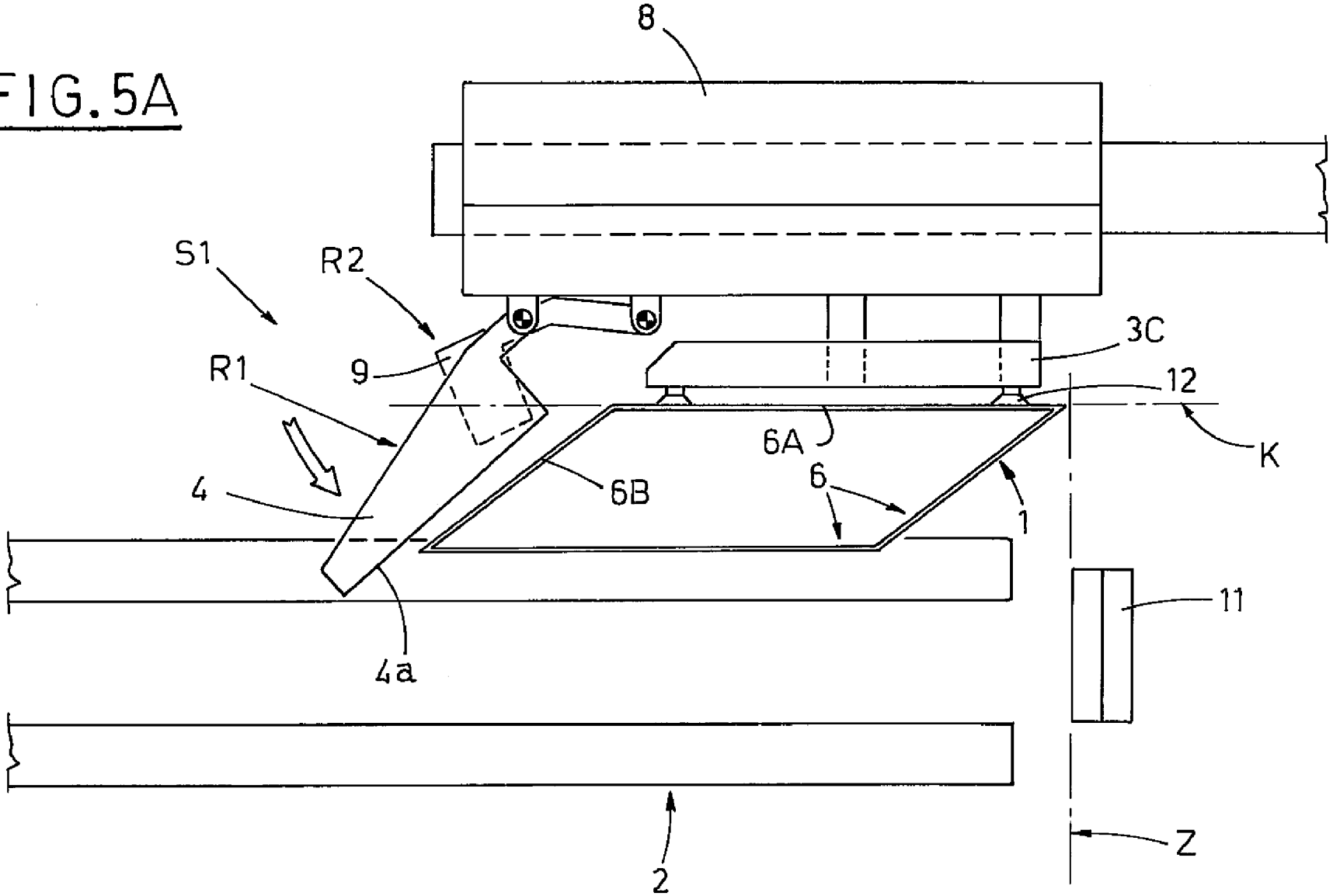
FIGS. 5A, 5B are the views analogous to FIG. 3, of the proposed station, respectively in the third and in a fourth significant work configuration.
Figure 5B:
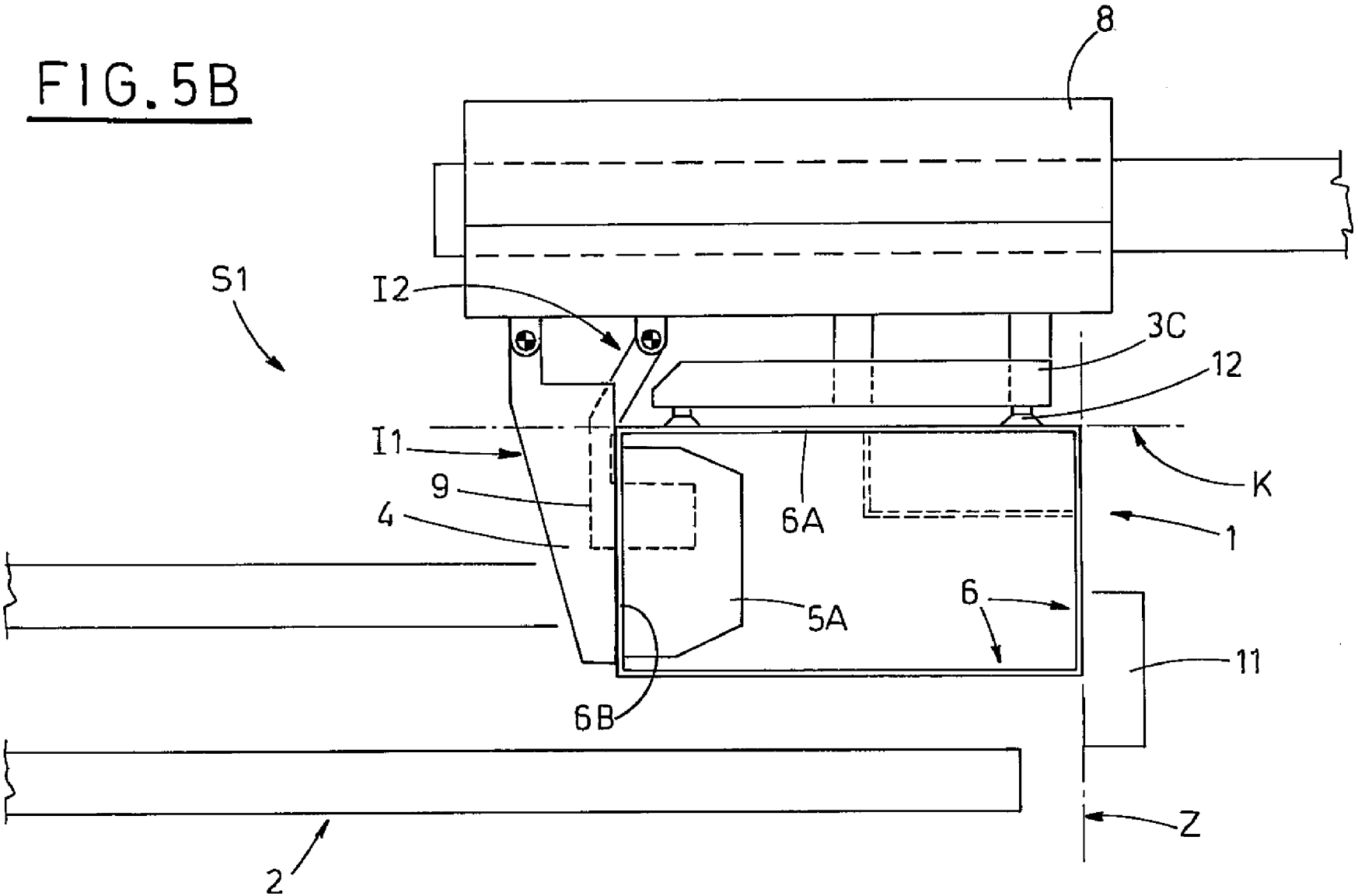

The first folding means 4 include a body, having a flat surface 4*a* and hinged to the carriage 8 with possibility of rotation about a vertical axis between a rest position R1 and a strike-and-fold position I1 in which it strikes and folds the second lateral wall 6B of the tubular blank 1 (see FIGS. 5A-5B).

The means 4 are also subjected to first actuator means (not shown for sake of simplicity).

The second folding means 9 include an arm 9A, pivoted at one side to the carriage 8 so as to rotate about a vertical axis, between a rest position R2 and a strike-and-fold position I2 in which it strikes and folds the first lower flap 5A of the tubular blank 1, and forming, on the other side, a hook-like element 9B (see for example FIGS. 1, 2, 4A, 4B).

Obviously, the means 9 are moved by second actuator means, not shown.

It is specified that the first and the second folding means 4, 9, as shown in the enclosed Figures, are situated upstream of the gripping and raising unit 3 with respect to the forwarding direction AV of the carriage 8 in the work station.

Consequently, the first lower flap 5A is situated at the rear with respect to the direction AV.

Figure 6:
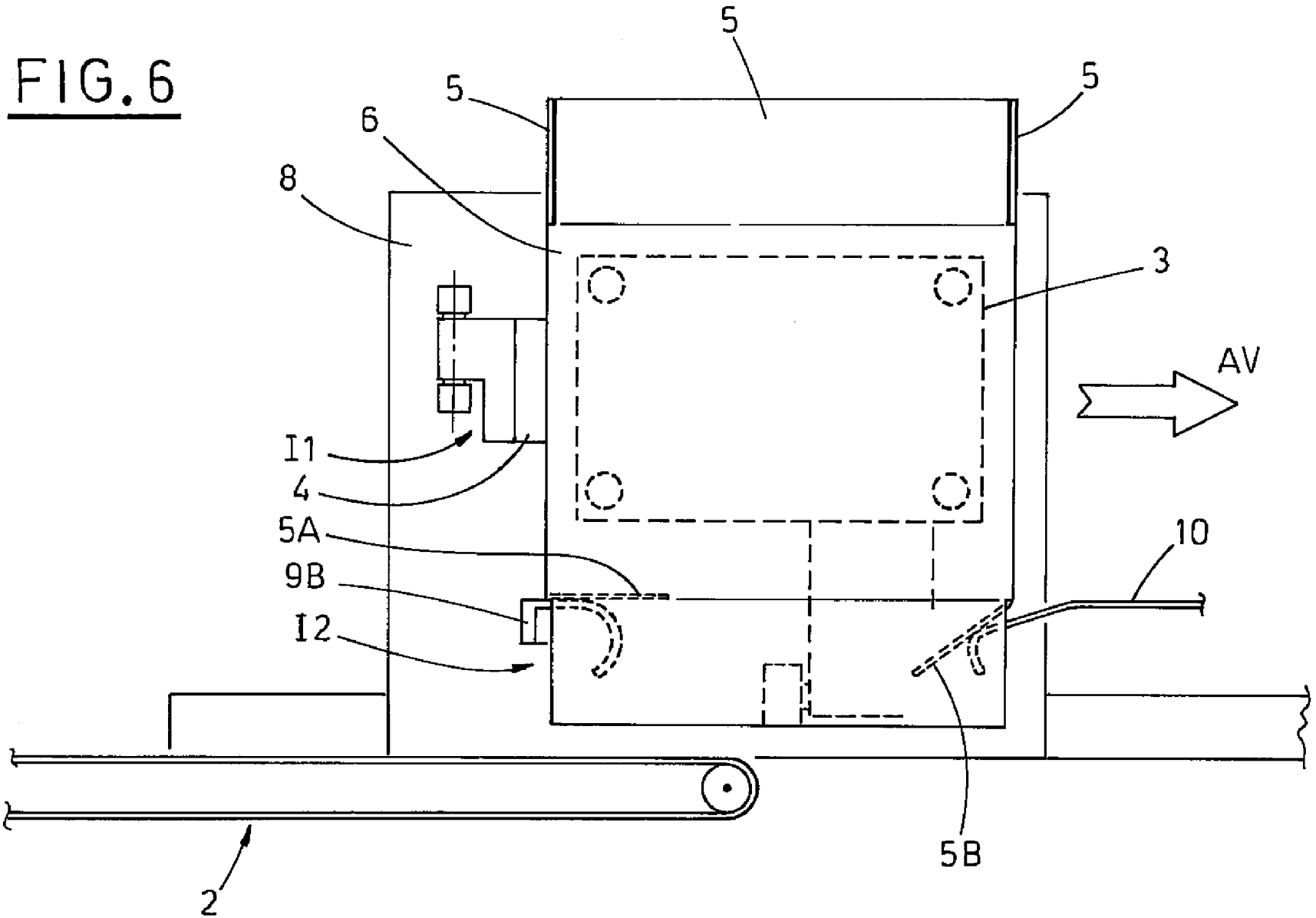
FIG. 6 is the view analogous to FIG. 1, of the proposed station on the basis of a fifth significant work configuration.

Finally, a third fixed folding element 10, whose profile is shown in FIG. 6, is situated near the work station (as already said, not shown).

Now, operation of the station proposed by the present invention will be described.

The work steps shown in Figures from 1 to 6, follow one another systematically and repetitively in the tubular blank 1 erecting station S1 as well as in the subsequent work station.

Therefore, reference will be made to the working cycle shown in the above Figures.

Figure 2:
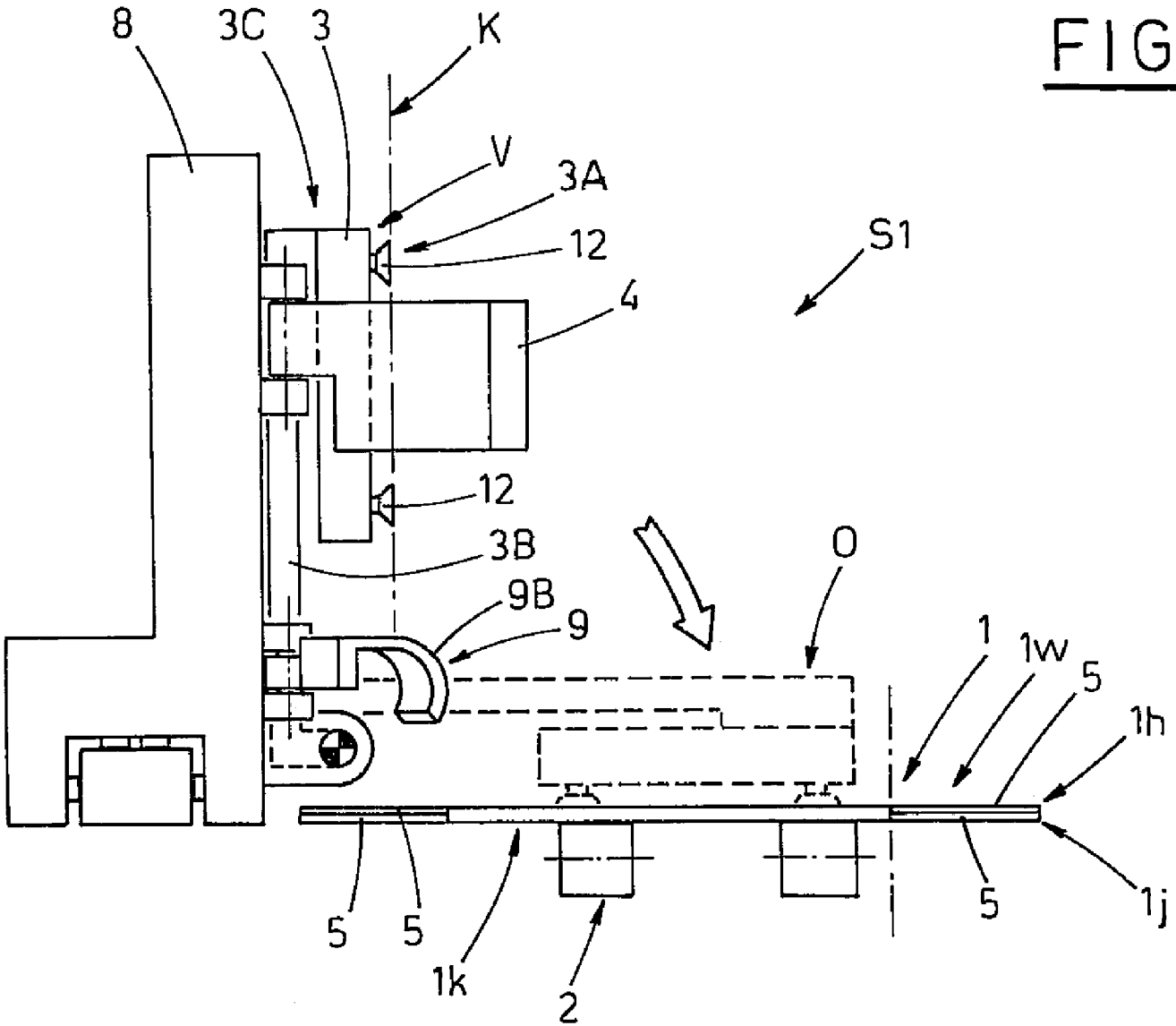
FIG. 2 is a schematic, lateral view, in continuous and broken line, of means of the station of the previous figure, respectively in the first work configuration and in a second significant work configuration.

In FIGS. 1, 2, a tubular blank 1 of a selected size (for example the maximum one), driven by the conveying means 2 to the erecting station S1, strikes against the fixed abutment 11, while the carriage 8 is in the erecting station S1 with the arm 3B set in the vertical position V and the first and second folding means 4, 9 are set respectively in the rest positions R1, R2.

Figure 3:
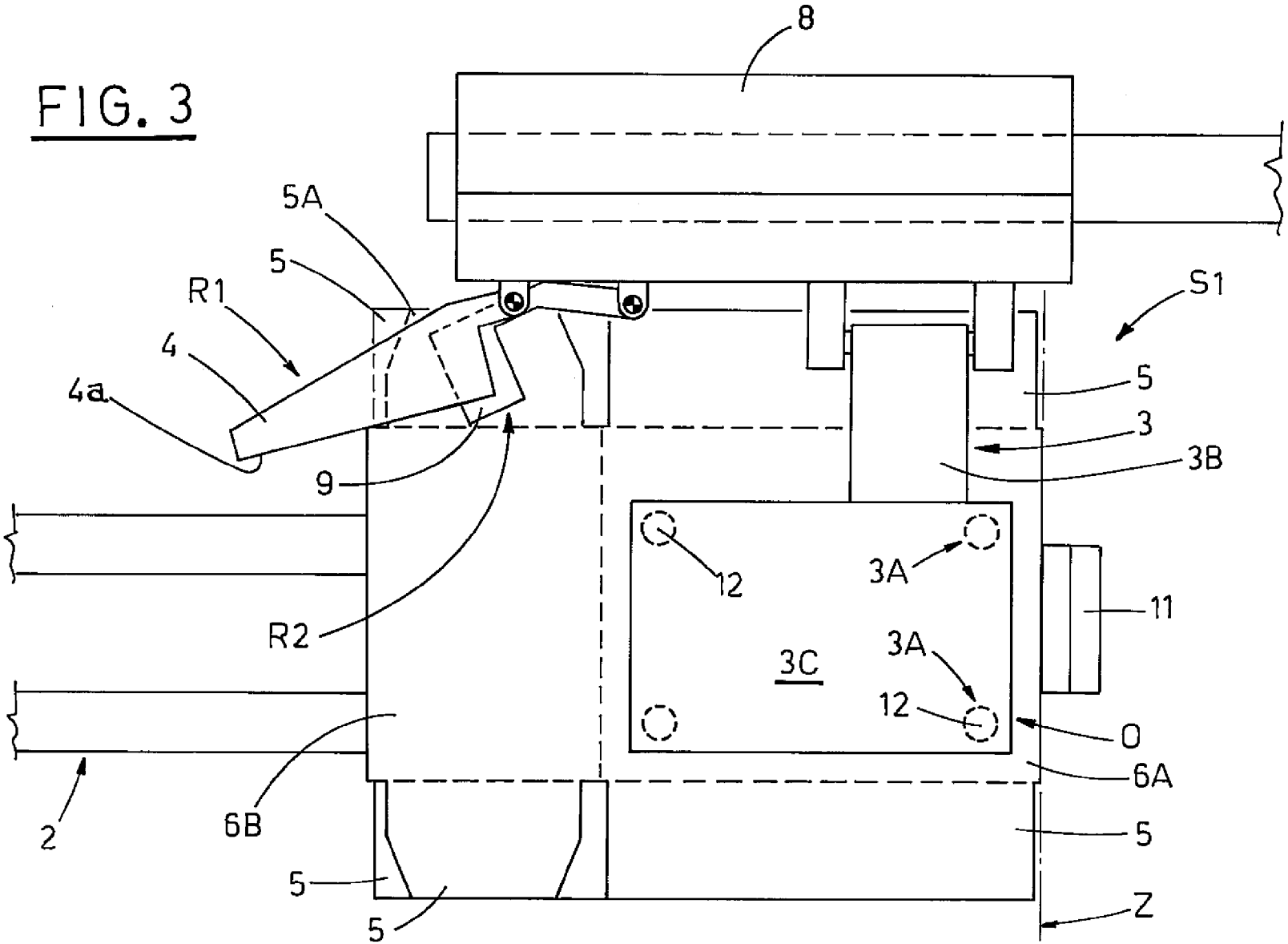
FIG. 3 is a top view of the station of FIG. 1, on the basis of the second work configuration.

This configuration is followed by the movement of the arm 3B to the horizontal position O, with a consequent contact with the first lateral wall 6A of the blank 1 by the suction cups 12 (see FIG. 3), the activation of the suction cups 12 to suck, so as to grip the blank 1, and the return of the loaded arm 3B, to the start vertical position V.

Then, the tubular blank 1 is raised, by the gripping action of the means 3A on the first lateral wall 6A, and at the same time, rotated by a 90° angle, bringing the first lateral wall 6A from a horizontal position to a vertical position, in which it is aligned with the second fixed reference plane K.

Figure 4B:
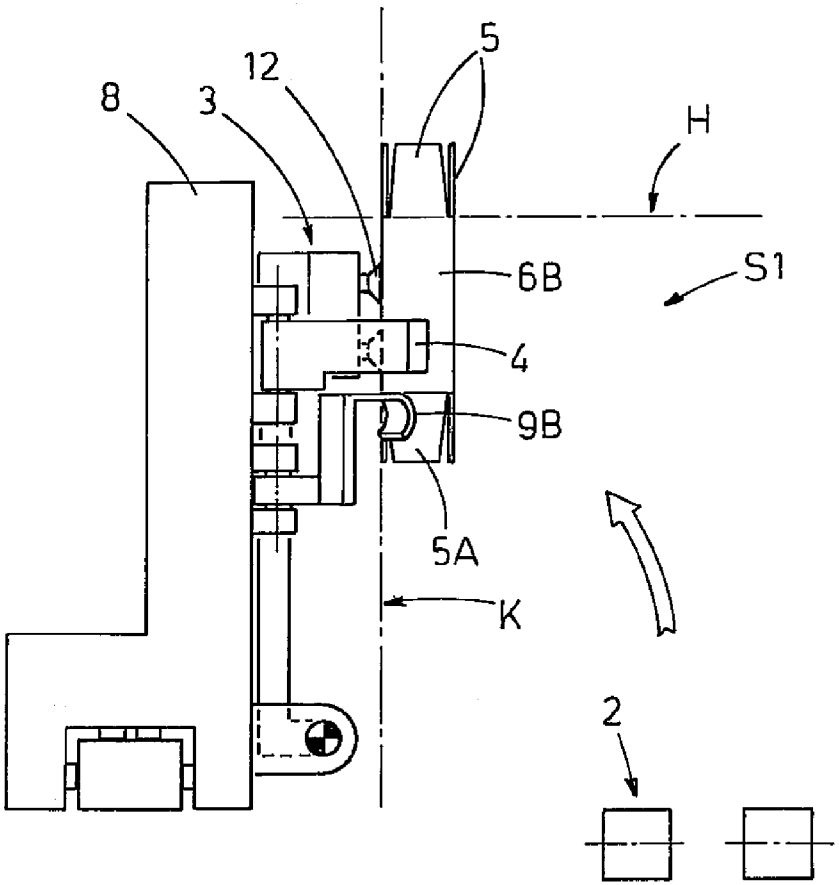
FIGS. 4A, 4B are the views analogous to FIG. 2, of the proposed station on the basis of a third significant work configuration, respectively in case of maximum and minimum size of the tubular blanks.
Figure 4A:
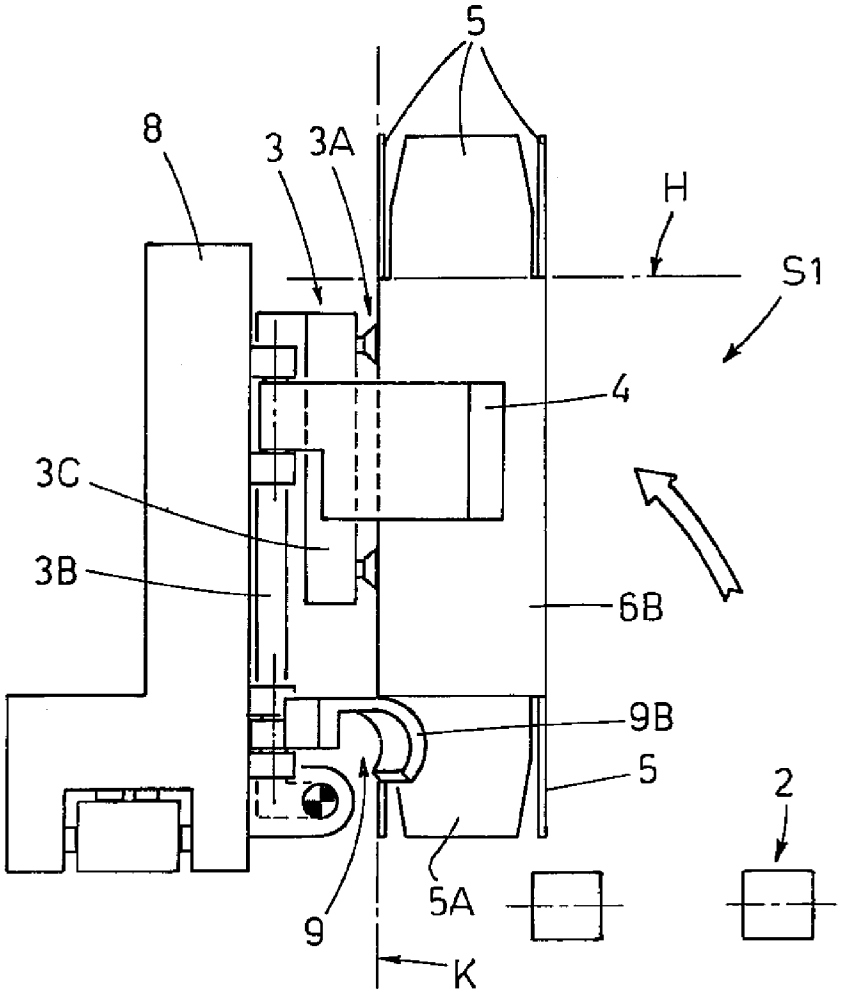

In particular, the weight of the blank 1 and its raising and rotating, cause its partial erecting, making it assume a parallelepiped form with a vertical axis (FIGS. 4A, 5A).

The blank 1 remains in this raised position until the cycle ends, with the upper transversal pre-creasing lines, which define the cover of the corresponding box being formed, aligned with a third fixed horizontal plane H, shown in FIGS. 1, 4A, 4B, described later on.

The first and second folding means 4, 9 are operated by the first and second actuator means in reciprocal step relation and with the loaded arm 3B having reached the vertical position V.

During the passage from the rest position R1 to the strike-and-fold position I1, the flat surface 4*a* of the body 4 abuts against and pushes the second lateral wall 6B of the blank 1, until said wall is oriented at a 90° angle with respect to the adjacent first lateral wall 6A.

In this way, the tubular blank 1 is erected and assumes the rectangular parallelepiped form with a vertical axis.

Likewise, the arm 9A of the second folding means 9 is brought from the rest position R2 to the position I2, in which the hook element 9B strikes against the first lower flap 5A of the blank 1, adjacent to the second lateral wall 6B, which is consequently, folded by a 90° angle.

The striking of the hook element 9B against the first lower flap 5A occurs, e.g. after the tubular blank 1 has been erected.

FIG. 5B shows the erected blank 1 with the relative first lower flap 5A folded by a 90° angle.

Finally, the carriage 8 is operated by relative actuators to move from the erecting station S1 to the work station in the forwarding direction AV.

During this movement, the second lower flap 5B of the tubular blank 1, opposite to the first lower flap 5A, strikes against the third fixed folding element 10, and is therefore folded at right angle, as shown in FIG. 6.

The last step concludes the present cycle and the subsequent operations, such as defining the bottom of the box and filling it with piles of articles, are not relevant to the invention.

A new work cycle begins, when the unloaded carriage 8 moved back to the erecting station S1.

The above mentioned fixed planes, first Z, second K and third H, act each as a reference for the erected tubular blank 1 in the erecting station S1, being aligned respectively with the lateral wall, opposite to the second lateral wall 6B, with the first lateral wall 6A and with the relative upper transversal pre-creasing lines of the blank 1.

This is valid for the blanks of any dimensions, between a minimum size (FIGS. 4B, 5B) and a maximum size (FIGS. 4A, 5B), provided that the blank 1 is initially arranged in a suitable way on the conveying means 2 (which is anyway easy to carry out).

In the work station, e.g. an article filling station, the first lateral wall 6A of the blank 1 remains aligned with the second fixed plane K and the upper transversal pre-creasing lines of the blank 1 remain aligned with the third fixed plane H.

In known solutions with article being supplied in vertical direction, the erected blank is usually moved to the filling station by conveying means, with its bottom already closed.

In this case, when the size is changed, the blank resting on the conveying belt maintains its bottom and its central line aligned with two corresponding fixed planes, one horizontal and the other vertical.

The alignment of the blank 1 with the third plane H, according to the invention, is extremely advantageous, because it allows setting at a minimum the stroke of the manipulating means (not shown, acting in the filling station), which introduce articles into the boxes being formed: actually, in case of containers of equal cross-section and the progressively decreasing height, the filling time becomes gradually shorter with respect to the prior art, because the vertical movement, which the manipulating means must perform, decreases proportionally to the box dimensions.

In this way, a drawback of the known solutions is resolved, as also the boxes of small dimensions are filled in satisfactory times, maintaining high production rate of the machine, independently from the size type being used.

As it can be guessed, still in the filling station, the alignment of the first lateral wall 6A of the blank 1 with the second fixed plane K allows setting to a minimum the transversal stroke of the manipulating means at the size change, giving the boxing machine a still higher production rate with respect to prior art.

As an alternative to the just described preferred embodiment, the carriage 8 can be substituted by a stationary frame: the whole above description would be extended to this variant, together with the manners of the tubular blank 1 erecting and the first lower flap 5A folding.

Thus, supposing that the unit 3 and the first and second folding means 4, 9 were connected to a stationary frame, Figures from 1 to 5B would be valid as to the general way of operation.

Obviously, it is also possible to suppose that the third folding member were operated by actuator means, which define the abutment and folding of the second lower flap 5B, like in already described case.

It goes without saying from the above description that in the erecting station S1 for the tubular blanks 1 in flat folded configuration the following operations are performed:

- conveying of the tubular blanks 1, one after another and in horizontal arrangement, to the erecting station S1 of the tubular blanks 1;
- striking of each blank 1 against a fixed abutment 11, situated in the station S1;
- gripping of the first lateral wall 6A of the blank 1 and its subsequent raising by a 90° angle rotation, so that the blank 1 assumes a parallelepiped form with a vertical axis, due to the raising with rotation and its weight;

striking the second lateral wall 6B of the blank 1, adjacent to the first lateral wall 6A, so as to define its arrangement at right angle with respect to the first lateral wall 6A, with consequent erecting of the blank 1;

striking the first lower flap 5A of the blank 1, situated behind with respect to the subsequent movement of the blank 1 in the prefixed forwarding direction AV, with a consequent inward folding thereof by a 90° angle;

moving of the blank 1 toward the work station, e.g. filling station, in the forwarding direction AV;

striking, in step relation with the moving of the blank 1 toward the work station, of the second lower flap 5B of the blank, opposite to the first lower flap 5A, with a consequent folding thereof by a 90° angle.

The raising of each blank 1 with a rotation, as it has already been said, causes the alignment of the first lateral wall 6A with the second fixed plane K, as well as the alignment of the upper transversal pre-creasing line of the blank 1 with the third fixed reference plane H.

The above mentioned alignments are maintained at least until the tubular blank 1 reaches the work station.

The advantage of the present invention lies in the fact that it defines a newly conceived station, which erects, along a vertical axis, flat folded tubular blanks in horizontal configuration, simplifying the subsequent steps of vertical filling of the box being formed with articles.

In this sense, the proposed station advantageously combines with a boxing machine for filling blanks with articles in vertical direction.

Another advantage of the invention lies in the fact that it is possible to change the tubular blanks 1 size without any decline of the production rate of the boxing machine, to which the station is associated.

Actually, with any dimensions of the blanks, their alignment in the work station (e.g. filling station) with the second and the third fixed planes K, H remains unchanged, so as to minimize the times of filling boxes being formed, as it has already been mentioned.

A further advantage of the invention derives from the fact that the structure of the proposed station is essential, and therefore it is reliable, highly productive and relatively cheap with respect to known solutions.

A still further advantage of the invention derives from the fact that it defines a newly conceived method for erecting tubular blanks, initially arranged in horizontal flat configuration.

In particular, the method includes erecting blanks in a vertical axis, simplifying the subsequent steps of filling in vertical direction of the corresponding boxes being formed.

The erecting operation and vertical arrangement of the blanks is also simple and essential, allowing a high productivity.

It is understood that the proposed invention has been described as a mere, not limiting example. Therefore, it is obvious that any changes or variants applied thereto remain within the protective scope defined by the following claims.

What is claimed is:

1. A station for erecting tubular blanks in boxes, with each blank including two superposed sheets connected along opposite ends of the sheets to define a flat folded configuration, with longitudinal pre-creasing lines made in said sheets for defining a first and a second lateral walls in each sheet and for facilitating folding of the blank, and with transversal pre-creasing lines made in the sheets for defining and facilitating folding of flaps of the blank, to which station said tubular blanks are conveyed one by one in a substantially horizontal position by driving means, with said erecting station including:

a gripping and raising unit for gripping said first lateral wall and for raising the blank in a way such that said blank rotates by a 90° angle into a vertical orientation;

first folding means acting on at least one second lateral wall, adjacent to said first lateral wall engaged by the gripping means of said unit, in step relation with the rotation of the blank, so that the blank assumes a parallelepiped shape while in the vertical orientation, said first folding means, operated by first actuator means, being hinged to a frame so as to rotate about a vertical axis, between a rest position and a strike-and-fold position for striking said second lateral wall and erecting the blank into a box, second folding means being hinged to said frame such that the second folding means rotate with respect to a vertical axis and are operated by second actuator means, in step relation with said first folding means, to fold at least a first lower flap of said tubular blank.

2. A station, according to claim 1, including a carriage provided for bearing at least said gripping and raising unit and said first folding means, said carriage being operated by carriage actuator means, in step relation with the operation of the first folding means, between said erecting station and a subsequent work station.

3. A station, according to claim 1, wherein said frame is stationary.

4. A station, according to claim 1, wherein said frame is a carriage moved by carriage actuator means between said erecting station and a subsequent work station, in step relation with the operation of said first folding means, said first lower flap being situated at rear with respect to a forwarding direction of said carriage toward said work station.

5. A station, according to claim 1, wherein said frame is a carriage moved by carriage actuator means between said erecting station and a subsequent work station, in step relation with the operation of said second folding means, said first lower flap being situated at rear with respect to a forwarding direction of said carriage toward said work station.

6. A station, according to claim 1, wherein said frame is a carriage moved by carriage actuator means between said erecting station and a subsequent work station, in step relation with the operation of said gripping and raising unit, said first lower flap being situated at rear with respect to a forwarding direction of said carriage toward said work station.

7. A station, according to claim 6, wherein said gripping and raising unit for gripping and raising said tubular blank includes an arm, bearing gripping means and hinged to said frame according to a horizontal direction perpendicular to said longitudinal pre-creasing lines of said tubular blank, said arm being moved by suitable actuator means between a horizontal position, in which said first lateral wall of said tubular blank in flat folded horizontal configuration is gripped, and a vertical position, in which said blank is rotated by 90°.

8. A station, according to claim 7, wherein said arm is hinged to said frame on one side, and on the other carries a plate-like element, which bears said gripping means, and in that said gripping means include corresponding suction cups connected to a source of vacuum.

9. A station, according to claim 1, wherein said first and second folding means are situated upstream of said gripping and raising unit with respect to the forwarding direction of the carriage in the work station, a third fixed folding element being placed at least near said work station for striking and folding, due to the movement of said carriage toward said station, a second lower flap of said tubular blank, situated at rear with respect to said forwarding direction and opposite to said first lower flap.

10. A station, according to claim 9, wherein said gripping and raising unit for gripping and raising said tubular blank includes an arm, bearing gripping means and hinged to said frame according to a horizontal direction perpendicular to said longitudinal pre-creasing lines of said tubular blank, said arm being moved by suitable actuator means between a horizontal position, in which said first lateral wall of said tubular blank in flat folded horizontal configuration is gripped, and a vertical position, in which said blank is rotated by 90°.

11. Station, according to claim 9, wherein said arm is hinged to said frame on one side, and on the other carries a plate-like element, which bears said gripping means, and in that said gripping means include corresponding suction cups connected to a source of vacuum.

12. A station, according to claim 1, including an abutment, situated in said erecting station for stopping said tubular blank conveyed thereto by said means, in step relation with the operation of said gripping and raising unit.

13. A station, according to claim 1, wherein said gripping and raising unit for gripping and raising said tubular blank includes an arm, bearing gripping means and hinged to said frame according to a horizontal direction perpendicular to said longitudinal pre-creasing lines of said tubular blank, said arm being moved by suitable actuator means between a horizontal position, in which said first lateral wall of said tubular blank in flat folded horizontal configuration is gripped, and a vertical position, in which said blank is rotated by 90°.

14. Station, according to claim 13, wherein said arm is hinged to said frame on one side, and on the other carries a plate-like element, which bears said gripping means, and in that said gripping means include corresponding suction cups connected to a source of vacuum.

* * * * *